US005425325A

United States Patent [19]

Washio

[11] Patent Number: 5,425,325

[45] Date of Patent: Jun. 20, 1995

[54] HIGH-SPEED LATERAL-STABILITY HULL CONSTRUCTION

[75] Inventor: Yushu Washio, Shimonoseki, Japan

[73] Assignee: Mitsubishi Jukogyo Kabushiki Kaisha, Tokyo, Japan

[21] Appl. No.: 113,247

[22] Filed: Aug. 30, 1993

[30] Foreign Application Priority Data

Aug. 31, 1992 [JP] Japan ..... 4-255695
Mar. 18, 1993 [JP] Japan ..... 5-083968

[51] Int. Cl.[6] ..... B63B 1/32
[52] U.S. Cl. ..... 114/290; 114/271
[58] Field of Search ..... 114/56, 61, 271, 274, 114/288–291; D12/300, 309, 310, 311, 313

[56] References Cited

U.S. PATENT DOCUMENTS

| | | | |
|---|---|---|---|
| 1,505,113 | 8/1924 | Warnock | 114/56 |
| 2,634,698 | 4/1953 | Becker | 114/291 |
| 2,919,669 | 1/1960 | Kikuhara | 114/291 |
| 3,045,629 | 7/1962 | Farrington | 114/56 |
| 3,602,179 | 8/1971 | Cole | 114/56 |
| 3,763,810 | 10/1973 | Payne | 114/291 |
| 3,776,168 | 12/1973 | Weeks | 114/56 |
| 4,635,580 | 1/1987 | Nishida | 114/56 |
| 4,660,490 | 4/1987 | Broadhurst | 114/56 |
| 4,919,063 | 4/1990 | Hall et al. | 114/274 |
| 5,199,367 | 4/1993 | Horiuchi et al. | 114/61 |
| 5,231,945 | 8/1993 | Akerbloom | 114/56 |

FOREIGN PATENT DOCUMENTS

| | | | |
|---|---|---|---|
| 81698/82 | 9/1982 | Australia . | |
| 78398/91 | 5/1992 | Australia . | |
| 0249321 | 12/1987 | European Pat. Off. . | |
| 2522556 | 9/1983 | France | 114/271 |
| 38-24447 | 11/1963 | Japan . | |
| 50-11300 | 2/1975 | Japan . | |
| 55-13200 | 3/1980 | Japan . | |
| 0226389 | 10/1986 | Japan | 114/56 |

*Primary Examiner*—Edwin L. Swinehart
*Attorney, Agent, or Firm*—Wendroth, Lind & Ponack

[57] ABSTRACT

A single-body transom type of hull includes reaction flaps extending along side platings of the hull in a direction from bow to stern over at least 10% or more of the length of the ship. Inner surfaces of the flaps, along with outer surfaces of the side platings, form structures having inversely U-shaped cross sections defining recesses of parabolic cross sections so that water may flow smoothly along the hull. The reaction flaps thus suppress the outward flow of spray from the hull and impart lateral stability to the hull even at high speeds.

10 Claims, 6 Drawing Sheets

HIGH-SPEED LATERAL-STABILITY HULL CONSTRUCTION

BACKGROUND OF THE INVENTION

1. Field of the Invention

The present invention relates to a hull provided with reaction flaps to impart lateral stability at high speeds.

2. Description of the Prior Art

Transom types of high-speed ships having a single hull in the prior art include a chine type of high-speed ship and a round bilge type of high-speed ship. The former type of high-speed ship is shown in FIGS. 15 to 17, and the latter type of high-speed ship is shown in FIGS. 18 to 19.

In these respective figures, reference numeral 1 designates the waterline, numeral 2 designates a wave washing up along a surface of the hull of the ship or spray from the bow during navigation, numeral 3 designates a wave at the transom of the ship, numeral 4 designates the direction of travel of the ship, numeral 5 designates an upper deck of the ship, numeral 6 designates a bottom keel of the ship, numeral 7 designates a chine, and numeral 8 designates a round bilge.

In the heretofore known single-hull transom types of high-speed ships, it was a common practice to employ a chine to form a squarish bilge as shown in FIGS. 15, 16 and 17 or to employ a slender hull having a large length-to-width ratio as shown in FIGS. 18, 19 and 20 for preventing waves from washing up along a surface of the hull or spray 2 from arising from the bow during high-speed navigation. It was also common practice to employ a small reaction flap, that is, a spray strip, for suppressing the spray 2.

It is well known that it is difficult for some types of ships to exceed a certain speed by merely increasing power. Rather, to achieve such a high speed it is necessary to reduce the tendency of the ship to produce outward spray. In general, a ship having a transom and exhibiting a smooth sliding performance at high speeds is to be considered.

In this regard, a large length-to-width ratio might inhibit the production of spray or waves. However, in this case, if the length-to-width ratio exceeds a certain fixed value, then the ship loses lateral stability. That is, the ship will heel too readily. Moreover, directional stability is also lost, and safe high-speed navigation becomes impossible.

Even if a ship has a sufficient stability when stationary, unless it has a sufficiently high stability, it will nonetheless become increasingly unstable at high speeds. This condition has been confirmed to a certain extent as a result of research in recent years.

In summary, if a ship of the heretofore known type were to have a length-to-width ratio smaller than a certain value and a stability, while stationary, that is not sufficiently large, such a ship would become laterally unstable at a certain high speed.

SUMMARY OF THE INVENTION

It is therefore one object of the present invention to provide a hull of a single-hulled ship having a transom and either a chine or round bilge, which suppresses wake and exhibits excellent lateral stability even at high speeds.

Another object of the present invention is to provide a hull that will produce a restoring force to counter large-amplitude rolling.

Still another object of the present invention is to provide a transom type of hull which will produce a large restoring force to counter rolling and which exhibits excellent lateral stability at high speeds.

In order to achieve these objects of the present invention, a transom type of hull of a single-hulled ship is provided with reaction flaps extending along both sides of the hull in a direction from bow to stern.

The reaction flap extends over at least about 10% of the length of the ship, is provided rearwardly of a fore perpendicular to the hull, and extends forwardly of a shoulder of the hull and with an upward inclination towards the bow. Furthermore, an inner surface of the reaction flap extends smoothly contiguously to an outer surface of the side plating to define a recess having a parabolic cross section so that water will flow smoothly in the recess. In other words, the structure constituted by the reaction flap and side plating has an inversely U-shaped cross section. The deepest portion of the recess is 100 mm or more.

It is to be noted that throughout the specification and claims of this application, the term "shoulder of a hull" refers to the location on the side plating where the width of the ship becomes maximum as viewed from the front of the ship.

The inner surface of the reaction flap according to the present invention preferably is inclined at an angle of 45° or less at the bottom of the flap, relative to a vertical plane passing through the hull and longitudinally thereof, so that the reaction flaps produce a force having vector components contributing to lateral stability of the hull.

Also, the recesses defined by the reaction flaps and side platings may have a fixed depth aft of the shoulder of the hull.

Still further, it is desirable that aft of the shoulder, the reaction flaps extend alongside a chine as directed downwards so that the reaction flaps will not reduce the amount of the hull that will be under water nor will the reaction flaps project laterally from the hull structure increasing the width of the ship.

Alternatively, the reaction flaps may be provided only from the fore perpendicular to the hull to the shoulder of the hull just to enhance the lateral stability of the hull.

Furthermore, the depth of the recess formed by the reaction flap and the side plating may gradually decrease from aft-to-stern in view of the resistance performance of the reaction flap.

Moreover, the reaction flaps should be located at a level above the waterline (the water surface when the hull is stationary) so as not to offer resistance even during low-speed navigation.

Also, the reaction flaps should extend over 10–30% of the length of the hull to be most effective in providing lateral-stability at high speeds.

In general, as a ship navigates at a high speed, a wave will wash up along the surface of the hull from a portion of the bow, and sooner or later will fall due to gravity. Such a wave produced by a hull forms a thin water film and is generally called "spray".

However, with the hull having the above-described reaction flaps according to the present invention, the wave or spray is not discharged directly outwards but first collides against the top of the inversely U-shaped section of the hull and is then turned obliquely and directed downwardly and outwardly. Consequently, an upward reaction force vector is generated by dynamic pressure of the wave or spray due to the collision thereof with the hull and the force produced as it is directed downwardly and outwardly. Since the reaction force vector component acts as a restoring force, it creates lateral stability during high-speed navigation.

More particularly, if the hull were to tilt laterally, then the reaction force produced by the reaction flap provided on the side of the ship tilted closest to the water would be larger than the reaction force produced by the other reaction flap, whereby a moment tending to restore the hull to an upright state would be produced.

The above-mentioned and other objects, features and advantages of the present invention will become more apparent by referring to the following description of preferred embodiments of the invention made in conjunction with the accompanying drawings.

DETAILED DESCRIPTION OF THE PREFERRED EMBODIMENTS

Figure 1:
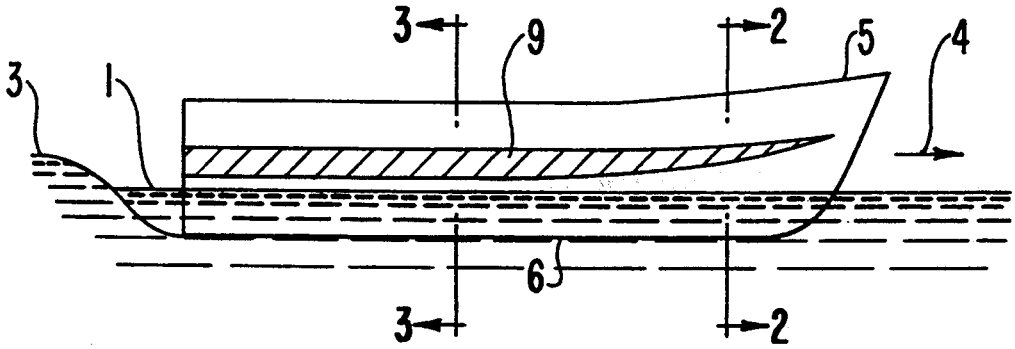
FIGS. 1 to 3 illustrate a first embodiment of a laterally stable hull according to the present invention, FIG. 1 being a side view thereof, FIG. 2 being a transverse cross-sectional view thereof taken along line 2—2 in FIG. 1, and FIG. 3 being a transverse cross-sectional view thereof taken along line 3—3 in FIG. 1.

Now, the present invention will be described in greater detail in connection with the first to fourth preferred embodiments of the present invention illustrated in the accompanying drawings. Throughout the drawings, reference numeral 1 designates the waterline, i.e. the water level while the hull is in a stationary state, numeral 2 designates a wave washing up along the surface of the hull or spray which washes from the bow of the hull during navigation, numeral 3 designates a wave arising at a transom of the ship, numeral 4 designates a direction of travel of the hull, numeral 5 designates an upper deck of the ship, numeral 6 designates a bottom keel, and numeral 9 designates reaction flaps of the hull forming, with side plates of the hull, structures having inversely U-shaped cross sections.

At first, a first preferred embodiment of the present invention will be described in FIGS. 1 to 3. The hull has a maximum width proximate the end of the stern thereof and reaction flaps 9. The flaps 9 begin rearwardly of the end of the bow and extend perpendicular to side platings of a freeboard above the waterline 1, and extend from the bow towards the stern while inclining downwardly. The reaction flaps 9 extend over $\frac{1}{3}$–$\frac{1}{2}$ or more of the length of the ship and the depth d of the deepest portion of each recess 10, to be described below, is 300 mm or more.

Figure 10:
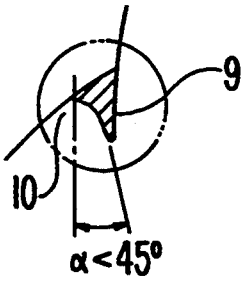

That portion of the hull formed by each side plate thereof and a respective reaction flap 9 has a flared inversely U-shaped cross section. More specifically, a recess 10 defined by the inner surface of the reaction flap and an outer surface of the side plate contiguous thereto has an inversed U-shaped cross section having a parabolic outline without points of inflection so that water may flow smoothly therethrough. It is to be noted that an inclination angle $\alpha$ (FIG. 10) of the inner surface of the lower end portion of the reaction flap 9 should be at least 45 degrees or less for the purpose of creating a reaction force vector component 11 contributing sufficiently to lateral stability.

In this connection, although the reaction flap 9 of the first embodiment extends from proximate the end of the bow to the stern, in practice, the reaction flap 9 is effective if it extends over about 20% of the length of the ship and the deepest portion thereof has a depth of 100 mm or more as illustrated in the third and fourth preferred embodiments which will be described later.

Figure 2:
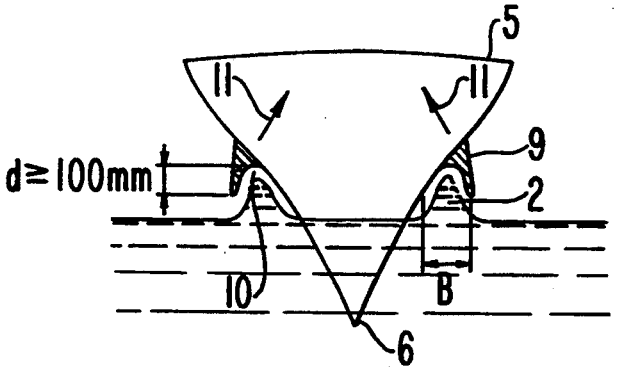
Figure 3:
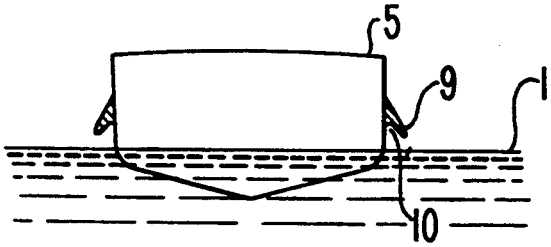

With such a hull, since a wave washing up along a surface of the hull from the bow during high-speed navigation or the resulting spray 2 is not repelled and splashed far from the hull, as shown in FIG. 2, the flaps 9 give rise to reaction force vector components 11 contributing greatly to the lateral stability of the hull.

Figure 16:
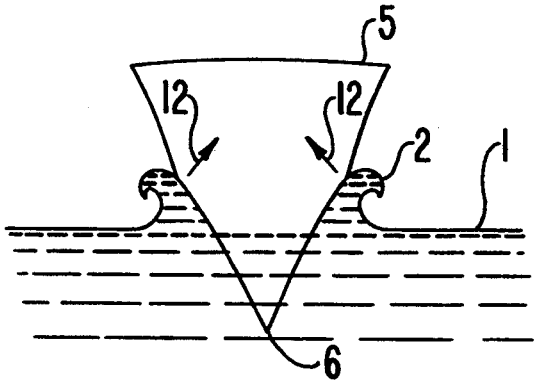
FIG. 16 (PRIOR ART)
Figure 17:
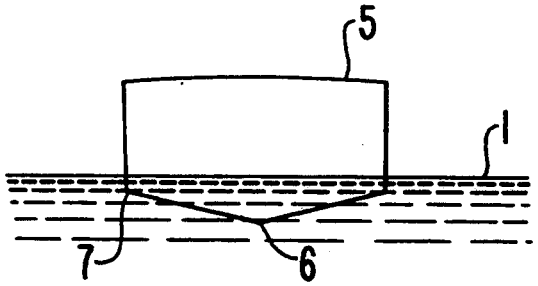
FIG. 17 (PRIOR ART)
Figure 18:
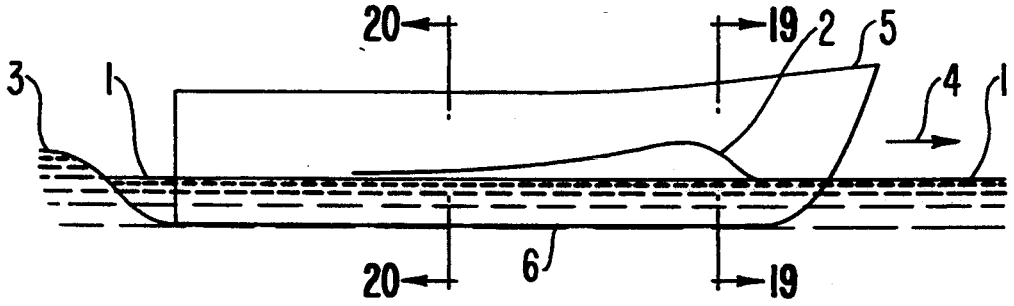
FIG. 18 (PRIOR ART)
FIGS. 18 to 20 illustrate a round bilge type of high-speed ship in the prior art, FIG. 18 being a side view thereof, FIG. 19 being a transverse cross-sectional view thereof taken along line 19—19 in FIG. 18, and FIG. 20 being a transverse cross-sectional view thereof taken along line 20—20 in FIG. 18.
Figure 19:
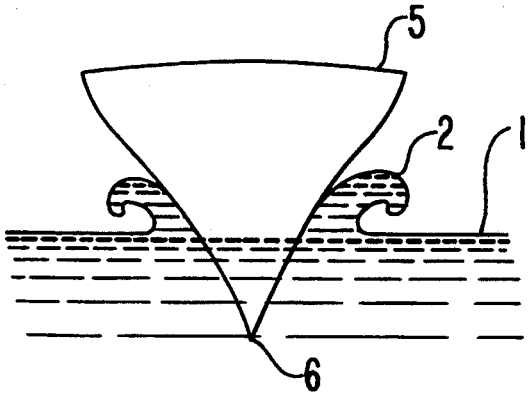
FIG. 19 (PRIOR ART)
Figure 20:
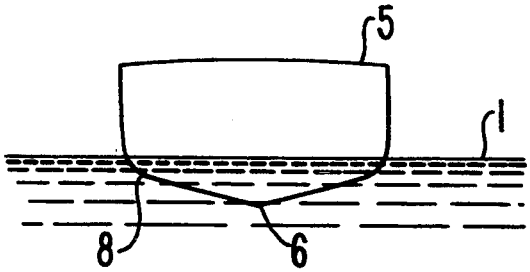
FIG. 20 (PRIOR ART)

In this connection, although vectors 12 contributing to lateral stability as shown in FIG. 16 were generated by the provision of chines or spray strips for suppressing spray in the prior art, the magnitude of these vectors were small and their effect was insufficient.

As shown in FIG. 2, the recess 10, formed by the reaction flap 9 and the side plate of the hull, has a maximum width B at its open end, and the recess 10 is defined by a smooth inner surface, free of points of inflection, whose cross section is parabolic such that the width of the recess 10 is gradually reduced towards the top of the ship. A wave or a spray rising along the hull is not immediately directed away from the hull but first collides against the top of the inversely U-shaped section of the hull and is then turned obliquely and directed downwardly and outwardly of the hull. Consequently, an upward reaction force vector 11 is generated by dynamic pressure of the wave or spray due to the collision thereof with the hull and the force produced as it is directed downwardly and outwardly of the hull. It is important that the reaction force vectors 11 provide a sufficient restoring force. Therefore, the reaction flaps 9 form a rigid structure with the side plating of the hull.

Next, a second preferred embodiment of the present invention will be described with reference to FIGS. 4 to 6. It is to be noted that the first preferred embodiment of the hull is formed by adding reaction flaps 9 to a hull structure. Hence, the first embodiment is applicable to the reconstruction of an existing ship. On the other hand, the reaction flaps of the second preferred embodiment of the hull are formed as a part of the hull structure when the hull is initially built. By the way, both the first and second preferred embodiments of ships of the same scale would have nearly the same configurations and waterline.

Figure 4:
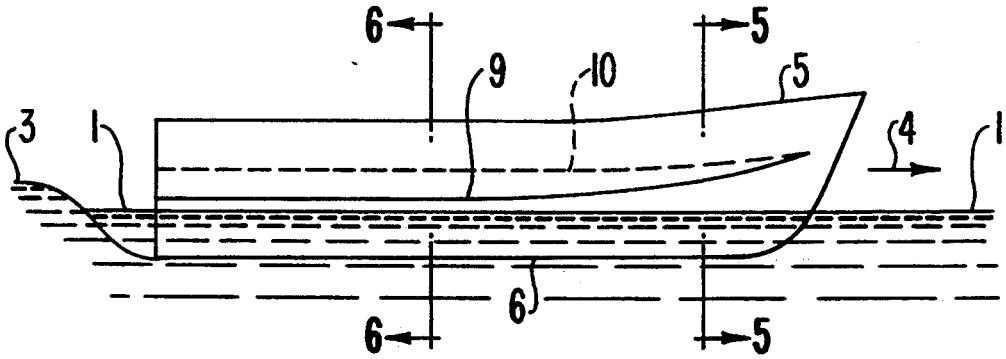
FIGS. 4 to 6 illustrate a second embodiment of a laterally stable hull according to the present invention, FIG. 4 being a side view thereof, FIG. 5 being a transverse cross-sectional view thereof taken along line 4—4 in FIG. 4, and FIG. 6 being a transverse cross-sectional view thereof taken along line 6—6 in FIG. 4.
Figure 5:
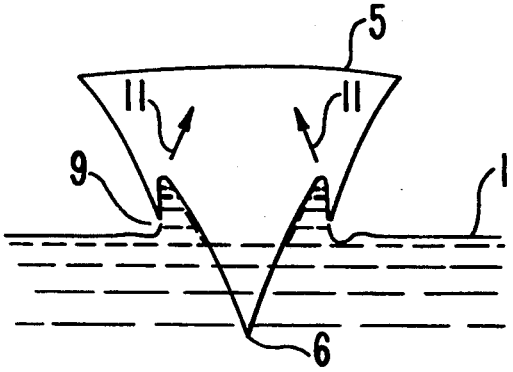
Figure 6:
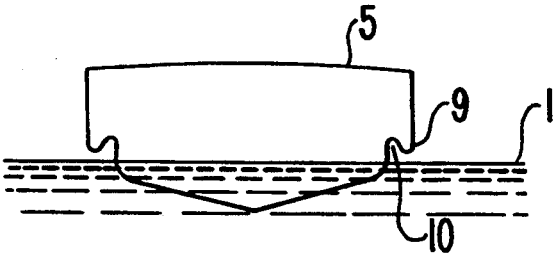

In the hull shown in FIGS. 4 to 6, reaction flaps 9 are provided above the waterline 1 and extend aft proximate a chine from the neighborhood of a maximum width portion of the ship (in a conventional ship, the maximum width portion is forward of the halfway point along the length of the ship).

The present inventor conducted a tank test to determine the relationship of the length of the reaction flaps 9 upon the lateral stability of the hull during high-speed navigation, and the following points were discovered.

Figure 7:
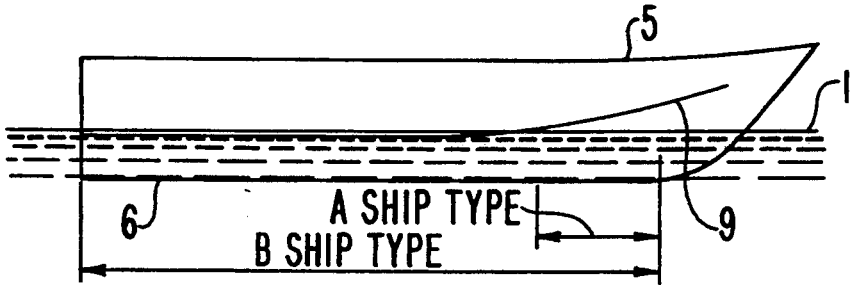
FIGS. 7 to 10 illustrate test results with respect to the hull of the present invention, FIG. 7 being a side view of a test model ship, FIG. 8 being a diagram of tank test results showing a relation between ship velocity and heel angle, FIG. 9 being a transverse cross-sectional view of the right half of the model ship in FIG. 7, and FIG. 10 being enlarged cross-sectional view of the part of the hull in FIG. 9 that is provided with a reaction flap.
Figure 8:
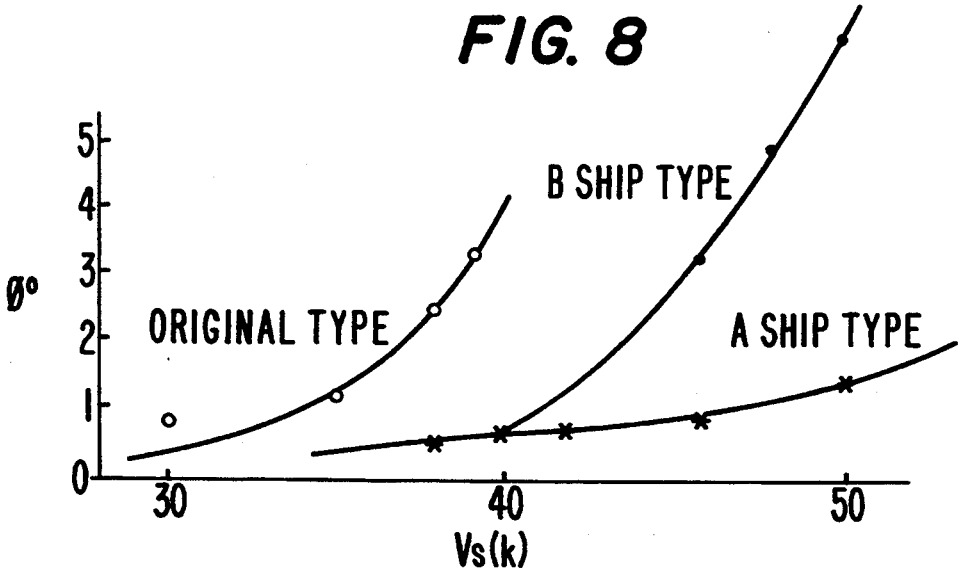
Figure 9:
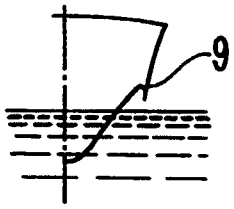

Referring to FIG. 7, the tests were conducted with an A type ship having reaction flaps 9 provided only at the bow over about 1/5 of the length of the ship, a B type ship having reaction flaps 9 extending over about 4/5 of the length of the ship, and a ship of heretofore known type which did not include reaction flaps. As shown in FIG. 8, although an angle of heel $\phi$ increases when the ship velocity Vs exceeds 30 kt in the case of the heretofore known type of ship, in the case of the B type ship the angle of heel $\phi$ increases remarkably when the ship velocity Vs exceeds 40 kt, and in the case of the A type ship the angle of heel $\phi$ increases gradually when the ship velocity Vs exceeds about 45 kt.

It is to be noted that the reaction flaps 9 of the B type ship extend below the waterline from the neighborhood of the maximum width portion of the ship.

It is thus seen that if the reaction flaps 9 are provided only at the bow above the waterline 1 as is the case with the A type ship, and if they extend over about 1/5 the length of the ship (about 10%–30% the length of the ship) and their depths d are each greater than or equal to 100 mm, then a good lateral stability is obtained. In addition, since the reaction flaps 9 are provided above the waterline they do not offer resistance during navigation.

Figure 15:
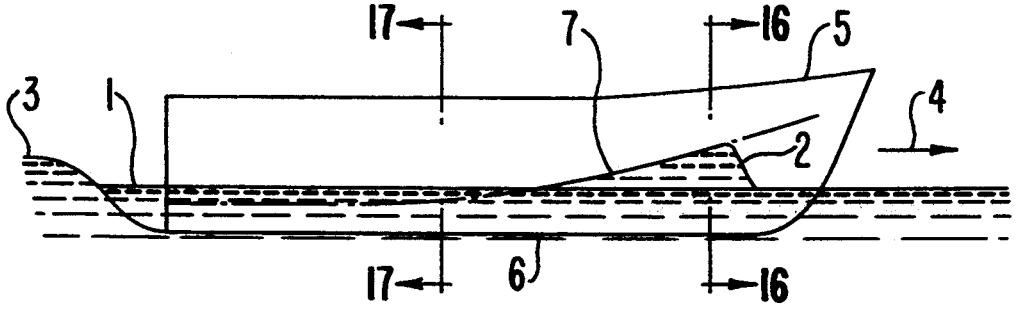
FIG. 15 (PRIOR ART)
FIGS. 15 to 17 illustrate a chine type of high-speed ship in the prior art, FIG. 15 being a side view thereof, FIG. 16 being a transverse cross-sectional view thereof taken along line 16—16 in FIG. 15, and FIG. 17 being a transverse cross-sectional view thereof taken along line 17—17 in FIG. 15.

On the basis of these test results, it can be said that the flaps are most effective when located above the waterline 1 at the bow but to the rear of the forward end of the ship and in front of a shoulder, that is, the maximum width position of the ship (in other words, only in the portion where the spray 2 largely arises as shown in FIG. 15).

By the way, the above-described tests were conducted with respect to a model ship on a scale of 1/12.3 and having a length of 3.8 m and a width of 0.63 m. The ship velocity Vs of 30 kt corresponds to 4.4 m/s (Froude number 0.7) in the test, and the ship velocity Vs of 40 kt corresponds to 5.9 m/s (Froude number 1.0). The "Froude number" is defined by $F=V\sqrt{G.L}$, where G: 9.8 m/s$^2$, L: ship length (m) and V: ship velocity (m/s).

Figure 11:
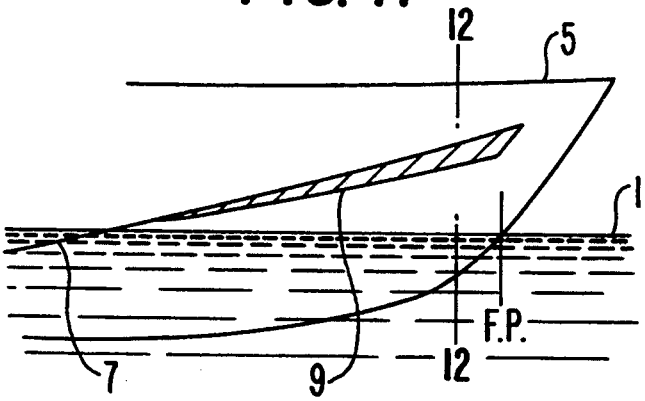
FIGS. 11 and 12 illustrate a third embodiment of a laterally stable hull according to the present invention, FIG. 11 being a side view thereof, and FIG. 12 being a transverse cross-sectional view thereof taken along line 12—12 in FIG. 11.
Figure 12:
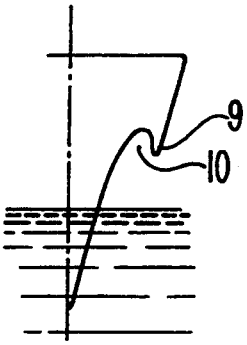

Next, a third preferred embodiment of the present invention will be described with reference to FIGS. 11 and 12. Recesses 10 defined by the reaction flaps 9 at the bow of the ship have depths d which decrease towards the stern from central portions of the flaps 9. This is because at the rear portions of the flaps, the effects of the reaction flaps are not so great since the height of the waves washing up at such portions is low, and if the depths d were constant the flaps would offer significant resistance. In addition, a length of each of the reaction flaps 9 is about 10%–30% of the length of the ship, a depth at the deepest portion of each recess 10 is about 100 mm or more, and an inclination angle $\alpha$ of the inner surface of the lower end portion of each flap is selected to be 45 degrees or less. Since the reaction flaps 9 are entirely located above the waterline 1, they offer no resistance to the water.

Figure 13:
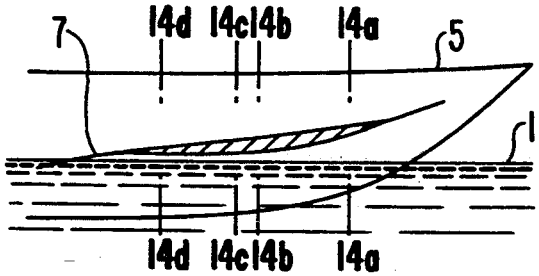
FIGS. 13 and 14(*a*)–14(*d*) illustrate a fourth embodiment of a laterally stable hull according to a fourth preferred embodiment of the present invention, FIG. 13 being a side view thereof, and FIGS. 14(*a*)–14(*d*) being enlarged cross-sectional views of part of the hull taken, respectively, along lines 14*a*–14*a*, 14*b*–14*b*, 14*c*–14*c* and 14*d*–14*d* in FIG. 13.
Figure 14A:
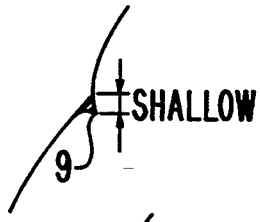
Figure 14B:
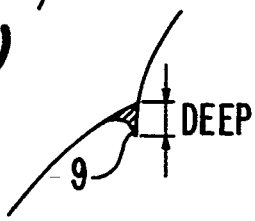
Figure 14C:
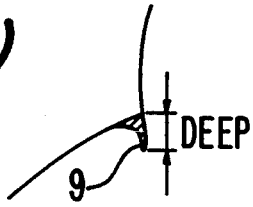
Figure 14D:
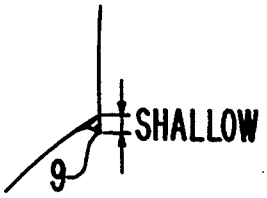

Next, a fourth preferred embodiment of the present invention will be described with reference to FIGS. 13 and 14. The recesses 10 defined by the reaction flaps 9 of the fourth preferred embodiment have depths d which decrease towards both the bow and towards the stern from central portions of the flaps 9.

More particularly, the recesses defined by the reaction flaps 9 do not need to be deep proximate the front portion of the bow because the front portions of the reaction flaps are too high for a wave to wash up therealong or because the front portions are so close to the fore as to be located away from the point where a wave begins to wash up along the hull. It is to be noted that like the third preferred embodiment, the reaction flaps 9 of the fourth preferred embodiment extend over about 10% –30% of the length of the ship, define recesses 10 having a maximum depth of about 100 mm or more, and have inner surfaces inclined outward at an inclination angle $\alpha$ of 45 degrees or less. The level of the bow reaction flaps 9 above the waterline is determined based on the magnitude of the spray 2 expected to be produced. According to this structure, raw material costs can be minimized, and in the case where the reaction flaps are provided as a unitary part of the hull structure as in the second preferred embodiment, the fourth preferred embodiment is especially effective.

The hull can achieve high speeds even in the region where problems of lateral stability occurred in the heretofore known types of ships. Even when the present hull is used to achieve the same speeds as the prior art ships, the length-to-width ratio can be comparatively greater and hence, the present hull can offer less resistance. Furthermore, even if the present hull were used to achieve the same speeds and to have the same length-to-width ratio as the prior art, the center of gravity of the hull could be higher without noticing a decrease in lateral restoring performance.

In addition, the hull of the present invention aims at improving lateral stability in a high-speed region. A base (the portion below the waterline 1) of a heretofore known type of hull can thus be employed in connection with the present invention. In this case, the reaction flaps 9 would not offer resistance in the medium and low speed regions.

Furthermore, the reaction flaps 9 of the invention can be applied to improve the performance of even (1) prior art ships in which lateral instability occurs if the ship speed exceeds a certain speed region and (2) types of ships whose center of gravity cannot be made higher because of the fact even if the ships have a sufficient stability while stationary, they would become unstable during high-speed navigation.

Also, the first and second preferred embodiments of the hull, having the cross sections shown in FIGS. 2, 3, 5 and 6, effect a great restoring force against rolling due to the fact that the reaction flaps 9 will become submerged in the water when the hull begins to roll.

Although the first and second preferred embodiments of the reaction flaps 9 are relatively long, extending from a position near the end of the bow to the end of the stern, in practice, the present invention is advantageous even if the reaction flaps are only located at the bow, provided that each of the flaps extend over about 1/5 the length of the ship (i.e. about 10%–30%) as in the third and fourth preferred embodiments.

If the latter embodiments are employed, because protrusions similar to bilge keels, spray strips and fin stabilizers are not present at the sides of the ship, the ship may readily approach the shore or an object broadside.

As described in detail above, the present invention provides a laterally-stable hull of a single-hull transom type of ship which, regardless of whether the ship has a chine or round bilge, has a small wave making resistance and yet exhibits excellent lateral stability even in the case of a Froude number of 0.7 or less.

Although the present invention has been described in detail above in connection with the illustrated embodiments, it is a matter of course that the present invention is not limited to these embodiments but many changes and modifications could be made thereto without departing from the scope of the invention as defined in the appended claims.

We claim:

1. In a single-hulled ship having a transom, the hull comprising: two sides each extending from bow to stern and forming a shoulder in the hull at which shoulder the hull has its maximum width, said two sides having outer surfaces forwardly of said shoulder which bow inwardly of the hull as viewed in a direction from top to bottom of the hull; and reaction flaps protruding from the sides of the hull and defining respective structures with sides of the hull each having an inversely U-shaped transverse cross section, said reaction flaps extending longitudinally with a rising inclination towards the bow and over at least 10% of the length of the ship, each of said reaction flaps located entirely aft of a fore perpendicular to the hull and at least part of the flaps being located forwardly of said shoulder, each of said reaction flaps being disposed entirely above the waterline of the ship, said flaps each having an inner surface smoothly contiguous to a said outer surface of a respective one of the sides of the hull, the contiguous inner and outer surfaces defining a recess having a parabolic transverse cross section free of points of inflection, and the recess having a maximum depth of at least 100 mm, whereby spray traveling along said contiguous surfaces produces a force at the bottom of each said recess having a vector component imparting lateral stability to the hull.

2. A hull in a single-hulled ship as claimed in claim 1, wherein the inner surface of each of said reaction flaps is inclined, at a lower end portion of each of the flaps, at an angle of 45° or less relative to a vertically extending plane passing through the hull longitudinally of the hull.

3. A hull in a single-hulled ship as claimed in claim 1, wherein said recess has a constant depth along each part of the respective reaction flap located aft of said shoulder.

4. A hull in a single-hulled ship as claimed in claim 2, wherein said recess has a constant depth along each part of the respective reaction flap located aft of said shoulder.

5. A hull in a single-hulled ship as claimed in claim 3, wherein the hull has a chine aft of said shoulder, and said part of the respective reaction flap is located proximate said chine and extends directly downward from the side of the hull.

6. A hull in a single-hulled ship as claimed in claim 4, wherein the hull has a chine aft of said shoulder, and said part of the respective reaction flap is located proximate said chine and extends directly downward from the side of the hull.

7. A hull in a single-hulled ship as claimed in claim 2, wherein said reaction flaps extend only in a region between said fore perpendicular to the hull and said shoulder.

8. A hull in a single-hulled ship as claimed in claim 7, wherein the depth of said recess decreases from fore-to-aft.

9. A hull in a single-hulled ship as claimed in claim 8, wherein each of said reaction flaps extends over 10–30% of the length of the hull.

10. A hull in a single-hulled ship as claimed in claim 1, wherein said outer surfaces of the hull, located forwardly of said shoulder, extend and are bowed inwardly of the hull from said flaps to the keel of the hull such that said inner and outer surfaces are contiguous without points of inflection from tip ends of the reaction flaps to the keel, respectively.

* * * * *